US005428975A

United States Patent [19]

Lee, III et al.

[11] Patent Number: 5,428,975

[45] Date of Patent: Jul. 4, 1995

[54] DOUBLE ROLL FOOTEE SOCK

[75] Inventors: Thomas C. Lee, III, Ooltewah; Jackson Ewing, Ten Mile, both of Tenn.

[73] Assignee: Crescent Hosiery Mills, Niota, Tenn.

[21] Appl. No.: 218,570

[22] Filed: Mar. 28, 1994

[51] Int. Cl.[6] ..... D04B 1/00; A41B 11/00

[52] U.S. Cl. ..... 66/178 R; 2/239; 66/172 E; 66/172 R

[58] Field of Search ..... 2/239; 66/171, 172 E, 66/178 R, 172 R, 188, 194, 176

[56] References Cited

U.S. PATENT DOCUMENTS

| | | | |
|---|---|---|---|
| 1,206,171 | 11/1916 | Theirfelder | 66/172 R |
| 1,781,196 | 11/1930 | Rosenberg | 66/172 R |
| 2,926,512 | 3/1960 | Robertson | 66/178 R |
| 2,974,508 | 3/1961 | Westmoreland | 66/194 |
| 3,255,613 | 6/1966 | Burd | 66/172 R |
| 3,274,804 | 9/1966 | Thorneburg et al. | 66/171 |
| 3,479,844 | 11/1969 | Silvan | 66/176 |
| 3,875,768 | 4/1975 | Arndt | 66/172 R |
| 3,990,115 | 11/1976 | Nester | 66/172 E |
| 4,034,580 | 7/1977 | Holder | 66/172 E |
| 4,150,554 | 4/1979 | Cassidy, Sr. | 66/172 E |
| 4,255,949 | 3/1981 | Thorneburg | 66/185 |
| 4,326,393 | 4/1982 | Dunlap | 66/172 E |
| 4,513,589 | 4/1985 | Kearns | 66/180 |
| 4,630,455 | 12/1986 | Lingenfelter | 66/172 R |
| 4,702,091 | 10/1987 | Good et al. | 66/171 |

*Primary Examiner*—John J. Calvert

*Attorney, Agent, or Firm*—Bell, Seltzer, Park & Gibson

[57] ABSTRACT

A knit footee having a body portion and a top portion connected to the body is disclosed. The top portion includes a first top increment comprising a plurality of completed courses and having a tendency to roll outwardly upon itself and a second top increment comprising a plurality of completed courses connected along a common border to the first top increment and to the neck portion. The first top increment has an inner edge connected at the common border to the neck portion and extending downwardly from the inner edge and from the common border over the neck of the body. The second top increment extends upwardly from the border portion and then downwardly to the neck portion forming a loop. The first and second top increments are secured to the neck portion at the common border portion. The second top increment snugly constricts the top portion when in relaxed condition to cause the top portion to grip the lower ankle area of the wearer.

6 Claims, 1 Drawing Sheet

DOUBLE ROLL FOOTEE SOCK

BACKGROUND OF THE INVENTION

1. Field of the Invention

The present invention relates to a cuffless or footee sock construction. More particularly, this invention relates to a double roll footee sock and method of producing the same including a double rolled top portion adapted to encircle the lower ankle area of the wearer.

(2) Description of the Prior Art

"Footee" or cuffless socks have been proposed for wear inside of a shoe and to be substantially covered thereby. These socks have been knitted on a circular knitting machine in which the top portion has been formed using elastic yarn. One difficulty with footee socks is that they have a tendency to slide down into the shoe.

In the past, it has been proposed to form a top portion of the sock using elastic yarn and to provide a top portion which is rolled outwardly to rest over the top of the shoe to reduce the tendency to slide into the shoe. However, the manufacture of such socks requires extra manufacturing steps, such as an expensive cutting and sewing operation or special knitting techniques, and thus extra expense. One such sock requires that a portion of the ankle material be cut or trimmed to form the foot receiving opening and then the cut edge is bound to prevent ravelling while an elastic band is secured to the opening to permit stretchability and to aid in preventing the upper edge of the sock from sliding down into the shoe. Other types of footee socks have been formed with support tabs or flaps which fold down over the top of the heel of the shoe to prevent the sock from slipping down into the shoe.

SUMMARY OF THE INVENTION

In accordance with the present invention there is described a knitted footee sock which is produced entirely on a circular knitting machine. The knitted footee has a body portion including a toe portion and a heel embracing portion, and a top portion connected to the body portion having a neck portion and adapted to encircle the lower ankle area of the wearer.

Starting with the top of the sock and working downward, the steps of making the sock include:

Knitting a first top increment having a plurality of completed courses and having a tendency to roll outwardly upon itself. To make the first top increment elastic is laid-in around which the start of the sock top is formed. As soon as the elastic is laid-in, a spun yarn and a backing yarn are laid-in and several regular knotted courses are made. The first increment of the top portion may also includes terry loops extending outwardly therefrom. In a preferred embodiment the front portion of the first increment, i.e., the portion facing the shoe laces, is one half or less of the courses of the back portion. Additionally, the front portion of the first top increment is generally knit with fewer courses for about one-half of the circumference around the neck portion.

Next, half of the needles are taken out of action while a typical heel embracing portion is knit on the back of the sock. Following the completion of the heel embracing portion, all needles are put back into action and the spun yarn and backing yarn fingers are taken out of action.

A second top increment is next knitted. This second increment has a plurality of completed courses of outwardly turned welt connected along a common first border portion to the first top increment and connected to the neck of the body portion. At the same time, that the spun yarn and backing yarn fingers are taken out of action, spun yarn, normally of a different color from the first spun yarn, and an end of elastic are laid-in, and ever other needle is raised out of action creating an outwardly turn welt causing a terry-like effect by the spun yarn when the elastic draws in. Both yarns are knitted on every other needle The needles that are out of action hold the stitches that allow attachment of the first increment portion to the body portion at the neck after the second top increment has been knit. Elastic yarn is incorporated in each of complete courses of the second top increment to constrict the top portion when in relaxed condition and to cause the top portion to grip the lower ankle area of the wearer.

The first top increment has an inner edge connected along the common border portion for attachment to the neck portion and extending downwardly from the inner edge and from the first border portion over the neck of said body. The second top increment extends upwardly from the first border portion and then downwardly to the neck where it joins the body portion.

After the top portion has been completed, the foot portion and the toe portion are knit and the toe portion is closed. There is provided means for securing the first top increment and the second top increment at the common border portion to the neck portion. The increments are secured using lock stitches disposed in spaced relationship around said neck portion and adjacent to certain of the border portions for holding the border portions in position with respect to the remainder of said sock.

It is therefore, an object of the present invention to provide a double roll, top for footee sock construction which is inexpensive to manufacture, durable in structure and unusual in appearance.

Another object of the present invention is to provide a sock construction which has a plurality of rolled yarn increments which are joined together during the knitting operation and will maintain their shape through repeated washings.

Yet another object of the present invention is to provide a double roll top for sock construction which can be readily and easily produced using a conventional single cylinder circular knitting machine.

Still another object of the present invention is to provide a footee sock which has a top which will constrict to cause the top portion, when in relaxed condition, to grip the lower ankle area of the wearer and will yieldably hold the sock against being gathered into a shoe.

Other objects, features and advantages of the present invention will become apparent from the following detailed description when taken in conjunction with the accompanying drawings in which:

DESCRIPTION OF THE PREFERRED EMBODIMENT

Figure 1:
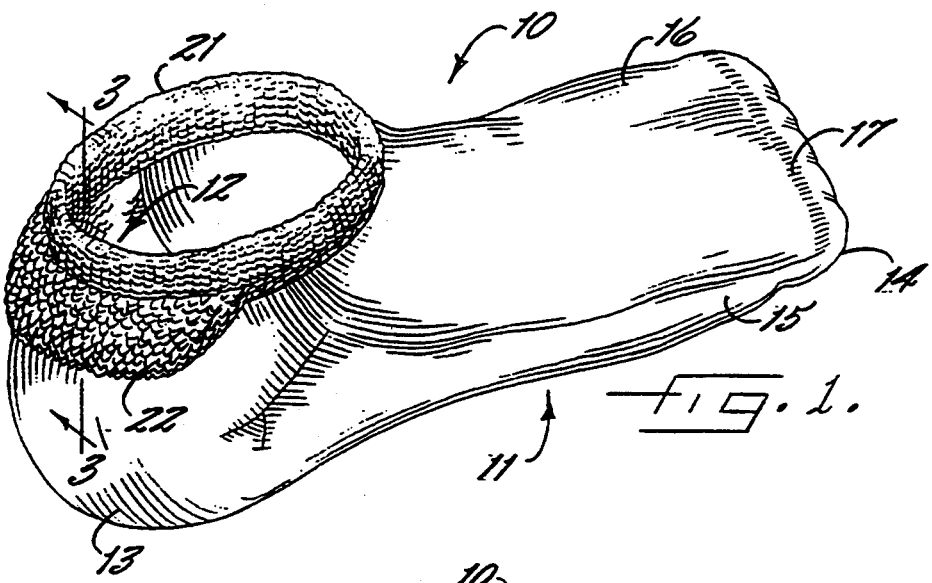
FIG. 1 is a perspective view illustrating the footee sock constructed in accordance with the present invention.

Referring now to the drawings, FIG. 1 shows a side view of the sock of the present invention in which there is shown a "footee" sock 10 constructed in accordance with the present invention. The sock includes a body portion 11 and a top portion 12. The body portion 11 has a heel embracing portion 13, a toe portion 14, and a seamless tubular portion connecting the heel and toe portions. The lower half of the seamless tubular portion defines a sole portion indicated at 15 and the upper half an instep portion 16. The toe portion 14 is closed in any suitable manner, such as by a looping or sewing operation along seam 17.

The top portion broadly indicated at 12 is integrally knit with the body portion 11 of the sock and is positioned above and closely adjacent the heel embracing portion 13 so that it encircles the lower ankle of the wearer. The area where the body portion 11 and the top portion 12 join defines a neck portion encircling the lower ankle area of the wearer.

Figure 3:
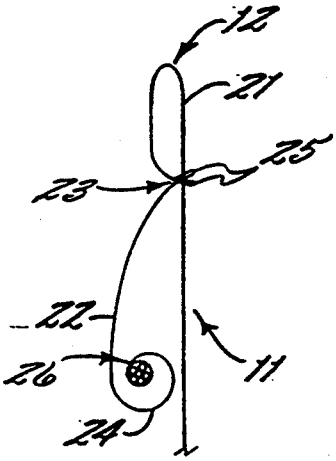
FIG. 3 is an exploded vertical sectional view showing the courses of the top portion and upper portion of the body of the sock taken along line 3—3 of FIG. 1.
Figure 4:
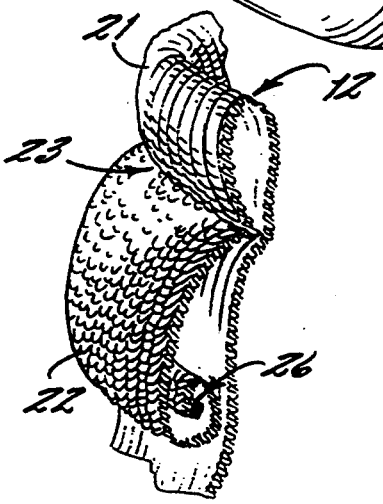
FIG. 4 is a fragmentary perspective view of the upper portion of the body and the top of the sock shown in FIG. 1.

As best shown in FIGS. 3 and 4, the top portion 12 includes a first top increment 22 comprising a plurality of completed courses and having a tendency to roll outwardly upon itself and a second top increment 21. The first top increment 22 has an inner edge 23 connecting to the neck portion and extending downwardly from said inner edge to an outer edge 24 terminating at end 26.

Figure 2:
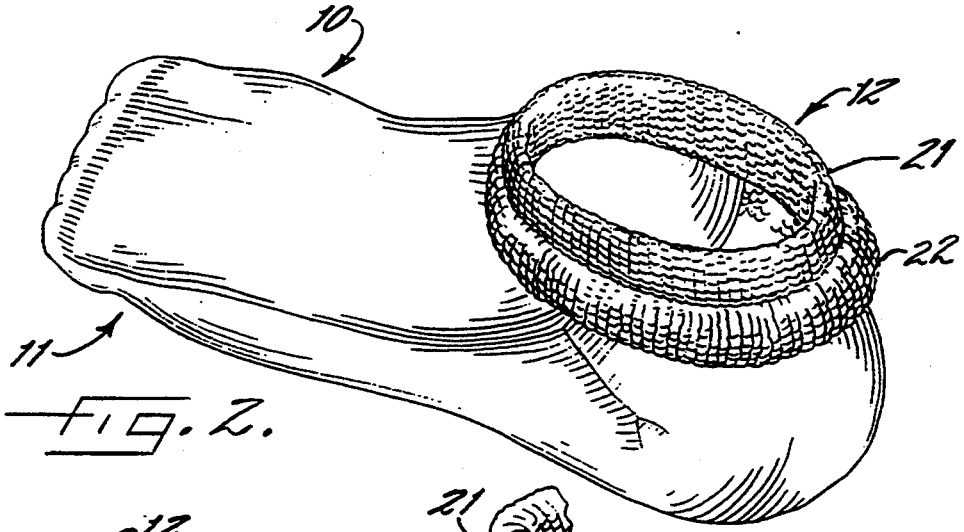
FIG. 2 is a perspective view illustrating an alternative embodiment of the footee sock constructed in accordance with the present invention.

The inner edge 23 is integrally knit with and forms a common border with the lower edge of the second increment 21—the outwardly turned welt. The inner edge forms a common border portion and is secured at 25 to the neck portion. The first top increment 22 terminates in a non-ravel lower salvage edge 24. As shown more clearly in FIG. 3, the first top increment 22 assumes an inwardly rolled condition when an elastic yarn is incorporated in the courses thereof, as by inlaying in the first course at the lower salvage edge 24. The first increment portion includes complete courses of the body yarn and the backing yarn with the same number of wales as the body portion 11 and extends down over and cover the upper edge of the wearer's shoe to aid in preventing the footee from being drawn down into the shoe. The elastic yarn incorporated in the first increment portion 22 causes it to roll inwardly upon itself and aids in maintaining the inwardly rolled condition. In the embodiment shown in FIG. 1, the front portion of the first increment portion 22 is one half or less of the courses of the back portion. The first top increment 22 of said top portion may also include terry loops extending outwardly therefrom. An alternative embodiment of the top portion of the sock is illustrated in FIG. 2 wherein the first increment 22 has the same number of courses around the entirety of the neck opening.

The second top increment 21, comprising a plurality of completed courses, is integrally knit or connected along a common border portion 23 to said first top increment 22 and to the neck portion. The second top increment 21 extends upwardly from said common border portion then downwardly toward the neck portion forming a loop. The second top increment includes an integrally knit outwardly turned reverse welt including courses of spun body yarn and elastic forming 8–16 complete courses. The second top increment aids in enabling the wearer to insert a foot into the sock by gripping the loop and the elastic yarn incorporated in each of the complete courses constricts the top portion 12 when in relaxed condition and causes the top portion 12 to grip the lower ankle area of the wearer.

The first top increment 22 and the second top increment 21 are secured to said neck portion at the common border 23. The increments may be secured in a variety of ways but one preferred way is through lock stitches disposed in spaced relationship around said neck portion and adjacent to the border portions for holding the border portions in position with respect to the remainder of the sock.

METHOD OF KNITTING

The footee sock of the present invention will be described as being knit on a conventional circular hosiery knitting machine and is knit from the top to the toe. However, it is to be understood that the footee sock could be knit on other types of knitting machines.

Initially, the first top increment 22 is knit. The start of the first top increment is to form the first course or make-up, wherein the elastic yarn, e.g., 6–8 rounds, is fed to every other needle while it is floated inside of the remaining needles during eight rotations of the needle cylinder. As soon as the elastic yarn is laid in, the spun body yarn, acrylic yarn may be used, is then fed to and forms stitch loops on every needle so that adjacent stitch loops are formed in the first course and on opposite sides of the inlaid elastic yarns. During the next rotation of the needle cylinder, the body yarn and backing yarn, this yarn may be nylon, are fed to all of the needles while the elastic yarn is still fed to the hook side of every other needle to make the first top increment of the sock. After the body yarn and the backing yarn have been laid in, several regular knitted courses, e.g., 4–8, are made. In the embodiment of FIG. 1, following the knitting of several courses, half of the needles are taken out of action while the remaining top portion 12 is knitted. The method for knitting the footee sock may include the step of forming terry loops in the first increment of the top portion.

At this time a typical heel embracing portion 13 is knit on the back of the sock by reciprocation of the needle cylinder and with fashioned gussets, however, the heel pocket 13 may be formed by any one of several well-known methods. The heel embracing portion 13 also includes inwardly extending terry loops formed therein.

Following the completion of the heel embracing portion, all needles are put back into action and the spun yarn and backing yarn fingers are taken out to knit the second top increment 21. At the same time, spun yarn and an end of elastic are put in, and ever other needle is raised out of action. The needles that are out of action hold the stitches that allow one to attach the first top increment portion 22 to the body portion after the second top increment 21 has been knit.

The second top increment 21 is formed using an end of elastic yarn and a spun yarn. Both yarns are knitted on every other needle creating a terried effect by the spun yarn when the elastic draws in.

The body portion 11 is knit with continuous rotation of the needle cylinder. Terry loops may also be formed in preferred portions of the body such as sole portion 15. The toe portion 14 is illustrated as being formed by reciprocation of the needle cylinder with fashioned gussets and the toe portion also includes terry loops formed on the inner surface. The toe opening is closed by any suitable means, such as seaming along a line 17.

The first top increment 22 and the second top increment 21 are secured at the common border portion to the neck portion. The top increments may be secured using lock stitches from each top increment disposed in spaced relationship around the neck portion and adjacent to the common border for holding the border in position with respect to the remainder of said sock. The elastic yarn in each of the complete courses of the second top increment 21 contacts the top portion when in relaxed condition to cause the top portion 12 to grip the lower ankle area of the wearer.

A very attractive footee sock is formed when the top portion includes both body and terry yarns and is knit of a different color yarn than the foot portion and each increment is of a different color yarn.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. A knit footee sock comprising a body portion including a toe portion, a heel embracing portion, a neck portion, and a top portion integrally knit to said neck portion, said top portion comprising:

a first top increment comprising a plurality of outwardly turned completed courses of terry loops, the terminal end of which turns inwardly upon itself;

a second top increment comprising a plurality of completed courses of outwardly turned welt connected along a common border portion to said first top increment and extending above said body portion from said common border portion and returning to said neck portion;

said first top increment having an inner edge connected along said common border to said neck portion and extending from said inner edge over the outside of said neck of said body portion; and means for securing said first top increment and said second top increment at said common border to said neck portion.

2. The knit footee sock according to claim 1 including elastic yarn incorporated in each of said complete courses of said second top increment to constrict said top portion when in relaxed condition to cause said top portion to grip the lower ankle area of the wearer.

3. The knit footee sock according to claim 1 wherein said means for securing includes lock stitches disposed in spaced relationship around said neck portion and adjacent to the common border for holding the top increments in position with respect to the remainder of said sock.

4. The knit footee sock according to claim 1 wherein a front portion of said first top increment portion is one half or less of the courses of the back portion.

5. A knit footee-type sock comprising a body portion including a toe portion and a heel embracing portion, and a top portion integrally knit to said body portion, said top portion comprising:

a first top increment comprising a plurality of outwardly turned completed courses of terry loops, the terminal end of which turns inwardly upon itself;

a second top increment comprising a plurality of completed courses of outwardly turned welt including elastic yarn incorporated in each of said complete courses of said second top increment to contact said top portion when in relaxed condition and to cause said top portion to grip the ankle of the wearer, connected along a common border to said top increment extending above said body portion from said common border and returning to said neck of said body portion;

said first top increment having an inner edge connected along said common border to said neck portion and extending from said inner edge over the outside of said neck of said body portion; and means for securing said first top increment and said second top increment at said common border portion to said neck portion, said for securing includes lock stitches disposed in spaced relationship around said neck portion and adjacent to the common border for holding said border in position with respect to the remainder of said sock.

6. The knit footee sock according to claim 5 wherein a front portion of said first increment portion is one half or less of the courses of a back portion.

* * * * *

UNITED STATES PATENT AND TRADEMARK OFFICE

CERTIFICATE OF CORRECTION

PATENT NO. : 5,428,975

DATED : July 4, 1995

INVENTOR(S) : Thomas C. Lee, III and Jackson Ewing

It is certified that error appears in the above-indentified patent and that said Letters Patent is hereby corrected as shown below:

Column 1, line 5, "1." should be -- (1) --.

Column 1, line 54, "includes" should be -- include --.

Column 2, line 6, "ever" should be -- every --.

Column 2, line 10, after "needle" insert a period (.).

Column 2, line 14, before "complete" insert -- the --.

Column 2, line 36, after "therefore" omit the comma (,).

UNITED STATES PATENT AND TRADEMARK OFFICE

CERTIFICATE OF CORRECTION

PATENT NO. : 5,428,975

DATED : July 4, 1995

INVENTOR(S) : Thomas C. Lee, III and Jackson Ewing

It is certified that error appears in the above-indentified patent and that said Letters Patent is hereby corrected as shown below:

Column 2, line 37, after "roll" omit the comma (,).

Column 3, lines 42 and 46, "salvage" should be -- selvage --.

Column 3, line 68, after "portion" (first occurrence) insert -- and --.

Column 4, line 58, "ever" should be -- every --. (2nd occurrence)

Column 6, line 42, after "said" insert -- means --.

Signed and Sealed this

Sixteenth Day of April, 1996

Bruce Lehman

BRUCE LEHMAN

*Commissioner of Patents and Trademarks*

*Attest:*

*Attesting Officer*